United States Patent [19]

Huber et al.

[11] Patent Number: 4,537,003

[45] Date of Patent: Aug. 27, 1985

[54] ELASTOMERIC SECTIONAL STRIP FOR EXPANSION JOINTS

[75] Inventors: Reinhold Huber, Bulach, Switzerland; Waldemar Koster, Forsbach, Fed. Rep. of Germany

[73] Assignee: Kober AG, Glarus, Switzerland

[21] Appl. No.: 518,238

[22] Filed: Jul. 28, 1983

[30] Foreign Application Priority Data

Jul. 29, 1982 [DE] Fed. Rep. of Germany ..... 3228315

[51] Int. Cl.[3] ..... E04B 1/68

[52] U.S. Cl. ..... 52/573; 52/396; 52/403; 404/65

[58] Field of Search ..... 52/573, 396, 403, 60, 52/61, 395, 402; 404/65, 64; 24/297, 573

[56] References Cited

U.S. PATENT DOCUMENTS

| | | | |
|---|---|---|---|
| 3,326,268 | 6/1967 | Dixon | 160/231 A |
| 3,447,430 | 6/1969 | Gausepohl | 52/395 |
| 3,460,282 | 8/1969 | Swirsky | 24/573 |
| 3,465,532 | 9/1969 | Belden | 52/396 |
| 3,516,114 | 6/1970 | Joyce | 160/231 A |
| 3,888,599 | 6/1975 | Reifsnyder . | |
| 4,367,976 | 1/1983 | Bowman | 404/64 |
| 4,423,979 | 1/1984 | Brown | 52/396 |

FOREIGN PATENT DOCUMENTS

| | | | |
|---|---|---|---|
| 6605223 | 1/1970 | Fed. Rep. of Germany . | |
| 2239574 | 8/1973 | Fed. Rep. of Germany | 52/61 |
| 2239354 | 2/1974 | Fed. Rep. of Germany | 16/225 |
| 3047904 | 7/1982 | Fed. Rep. of Germany . | |
| 520823 | 5/1972 | Switzerland . | |

*Primary Examiner*—Henry E. Raduazo

[57] ABSTRACT

An elastomeric sectional strip, for sealing an expansion joint on a building. Each edge of the strip is thickened for engagement in a corresponding one of a pair of grooves bordering the joint edges and is characterized by a three-point mounting of its thickened edge region inside each of said grooves. Each three point mounting is constituted by:

(a) a bulge on an upper side of the edge region, in which case said bulge is located inside said groove adjacent its opening;

(b) a shoulder projecting in the form of a wedge into said groove in the opposite direction to the insertion direction on an underside of said edge region, in which case after complete insertion, said shoulder bears against a corresponding stop face of the groove and (c) a camber on said upper side of said edge region close to its outer end.

4 Claims, 4 Drawing Figures

ELASTOMERIC SECTIONAL STRIP FOR EXPANSION JOINTS

FIELD OF THE INVENTION

The invention relates to an elastomeric sectional strip for sealing expansion joints on buildings, the edges of which strip are respectively thickened for connection in corresponding grooves in the edges of the joint.

Sectional strips of this type are known with varied constructions. They are distinguished inter alia as regards their folding principle, the method of attachment, the materials used or the like. For their construction, for example the area of use is an essential influence. A sectional strip in expansion joints of public roads is clearly subject to quite different requirements to a sectional strip provided for sealing expansion joints in building construction.

DESCRIPTION OF THE PRIOR ART

A known sectional strip for expansion joints (Swiss Patent Specification No. 520 823) comprises attachment edges constructed as a hollow profile. The hollow profiles fold together in a satisfactory manner, but are difficult to insert and inadequately prevented from being torn out.

In another known sectional strip for sealing expansion joints (German GM No. 6 605 223), the attachment edges are provided with barb-like projections, which spread out in a groove cavity adjacent the edge of the joint. Sectional strips of this type can only be mounted with difficulty and in particular on account of the related work of squeezing and deformation. This work is frequently made more difficult due to the fact that in narrow joints, the lateral grooves for receiving the attachment edges of the sectional strips are not easily accessible.

In another known sectional strip (German OS No. 30 47 904), for facilitating the assembly, cleats which can be bent back are formed on the free ends of the attachment edges. When the attachment edges are inserted in the corresponding grooves, these cleats bear against the sectional strip in the region of the attachment edges and after complete insertion they spread out against support surfaces constructed on corresponding cavity extensions of the attachment grooves. On the other hand, the aforementioned cleats prevent a desirable thickening of the attachment edges.

Finally, sectional strips also exist (U.S. Pat. No. 3,888,599) in which the edge thickening is squeezed into the corresponding attachment groove by utilizing the elasticity of a solid rubber part. In this case also, assembly is made more difficult and there is little to prevent tearing out.

It is the object of the present invention to provide a sectional strip with increased protection against tensile stress, which can be assembled with little expenditure, but nevertheless has a simple profile which is particularly advantageous for the extrusion method.

BRIEF STATEMENT OF THE INVENTION

This object is achieved according to the invention on a sectional strip of the aforementioned type due to the fact that (a) a bulge on the upper side of the edge region, in which case the bulge is located inside the groove adjacent to its opening, (b) a shoulder on the underside of the edge region projecting in the form of a wedge into the groove in the opposite direction to the insertion direction (F1), in which case after the complete insertion, the shoulder is supported against a corresponding stop face in the groove and (c) a camber on the upper side of the edge region on or close to its outer end.

According to feature (a) the upper bulge serves as an abutment and as a sealing lip, i.e. when the edge region is inserted completely in the attachment groove, the bulge is located within the groove, where it is pressed with a sealing effect against the adjacent inner wall. Furthermore, the bulges on both sides may contribute to facilitating fitting due to the fact that they form shoulders for fitting tools (FIG. 4).

The projection present on the underside serves for limiting the insertion travel when fitting the sectional strip. In this way, exact limiting of the depth of the groove is not necessary.

According to feature (b), the wedge-shaped shoulder projecting downwards serves for preventing the edge region of the sectional strip from being drawn out of the corresponding attachment groove. In conjunction with features (a) and (c) it is sufficient to construct this shoulder in a relatively weak manner, so that the deformation work at the time of fitting is slight. The wedge shape of the shoulder facilitates installation. When the edge region is completely inserted, a support face of the shoulder pointing towards the expansion joint comes to bear against a corresponding stop face of the groove, constructed as an inner extension of the groove.

The interaction of features (a), (b) and (c) occurs so that in the final fitted position, the camber provided towards the upper side of the sectional strip, on the outer end of the edge region, abuts against the adjacent groove wall to such an extent that the outer edge region is deflected as a whole away from the groove wall, which one could also describe as a type of pitching motion of the outer edge region of the sectional strip. As a result of the aforedescribed deflection of the outer edge region, produced with corresponding material deformation, the wedge-shaped shoulder on its underside is pressed in an increased manner behind the corresponding stop face of the groove in the direction increasing the stop effect.

In this case, the bulge on the upper side of the sectional strip (sealing lip) acts as an abutment for the deflection of the outer edge region. The fitted condition is thus characterised by a braced three point mounting between the support points of the camber, bulge and wedge-shaped shoulder (FIG. 3).

The concave fillet present on the opposite side of the camber or a corresponding concave shape of the outer edge region is necessary in order to deflect the latter in a corresponding manner into the attachment groove at the beginning of insertion, which takes place in a particularly advantageous manner with the assistance of a fitting tool. Furthermore, despite the head-like thickening of the outer edge region, the hollow fillet allows its unforced introduction through the narrowed outer groove section and serves as a stop face for the sectional strip, when it is placed in the joint gap (FIG. 4).

Naturally, within the framework of the invention, a certain construction of the attachment groove, adapted to the sectional strip, in particular to its edge region, is essential. For this purpose the invention proposes that the grooves each have a hollow cross-section adapted to the cross-sectional shape of the thickened edge regions, but which does not comprise the upper camber of the sectional strip and the height of which is less in the inlet region than the sectional thickness of the edge region, measured through the lower shoulder.

BRIEF DESCRIPTION OF THE DRAWINGS

One embodiment of the invention is described hereafter with reference to the drawings, in which.

DESCRIPTION OF A PREFERRED EMBODIMENT

Figure 1:
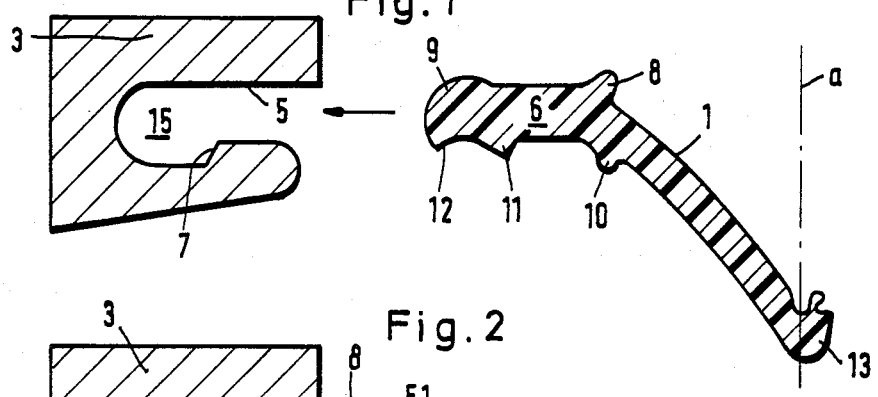
FIG. 1 is a cross-section through the left-hand half of a sectional strip outside the attachment groove.
Figure 2:
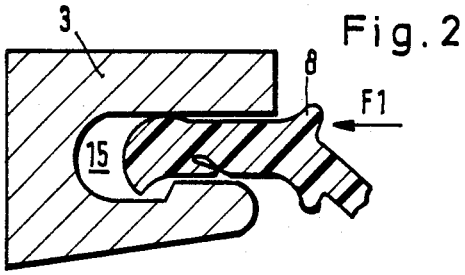
FIG. 2 shows the edge region of the sectional strip according to FIG. 1 half inserted in the attachment groove.
Figure 3:
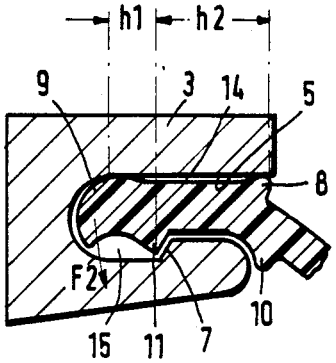
FIG. 3 shows the edge region of the sectional strip according to FIGS. 1 and 2, completely inserted in the attachment groove
Figure 4:
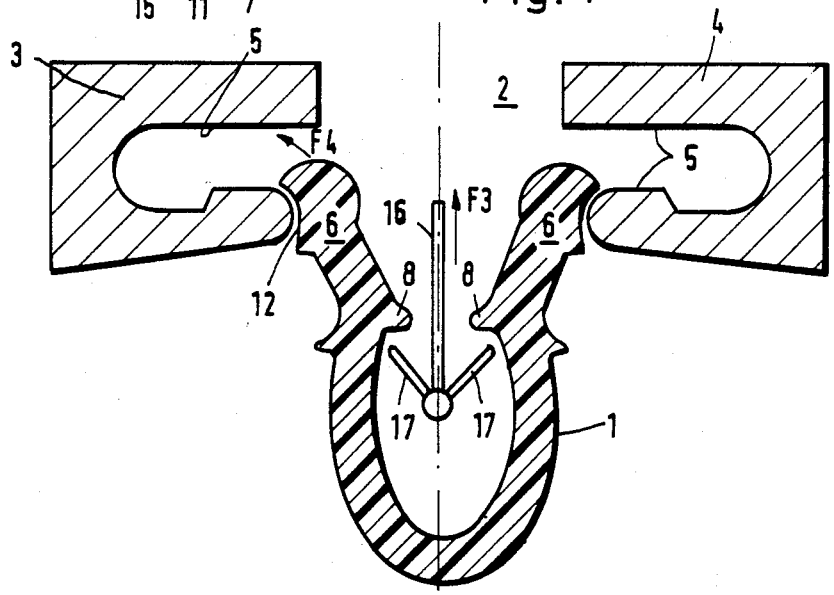
FIG. 4 shows a complete sectional strip cross-section in a position directly before the beginning of the assembly operation.

The assembly is illustrated in three stages in FIGS. 1 to 3, in which case the sectional strip itself is shown solely in each case as a partial cross-section, namely in FIG. 1 as a half section and in FIGS. 2 and 3 solely a cross-section through the edge region is shown. On the other hand, FIG. 4 shows the two joint edges 3, 4 limiting an expansion joint 2 and between the latter the complete sectional strip 1 in the initial position for assembly.

In the embodiment chosen in this case, the joint edges 3,4 are illustrated substantially as U-profiles, the sides of which define a groove 5 for receiving an edge region 6 of a sectional strip 1. The groove 5 has a narrowed inlet cross-section or on the inside an enlarged groove cavity 15, which is limited inter alia by an inwardly pointing stop face 7 of the lower side of the U-shaped profile.

Each edge region of the sectional strip 1 comprises a bulge 8 on the upper side and a camber 9 at the outer end of the edge region 6. On the underside, the edge region 6 comprises a projection 10 approximately opposite the said bulge 8, as well as a wedge-shaped shoulder 11. Opposite the camber 9, the underside of the profile comprises a hollow fillet 12. Moreover, in the edge region 6, the profile cross-section is somewhat thicker than in the remaining cross-sectional region of the sectional strip 1. The axis a extends vertically through the central bend 13 of the sectional strip 1.

According to FIG. 2, the edge section 6 has been inserted into the inside of the groove 5 by only approximately half. As will be seen in this figure the height of groove 5 in its inlet region is less than the thickness of the end portion of the sectional strip 1 measured through its shoulder 11. In the region of the narrowed inlet cross-section, the wedge-shaped shoulder 11 provided on the underside of the strip bears against the underside of the sectional strip at the time of insertion in the direction of arrow F1. The insertion may take place by means of a tool fitted on the bulge 8 in the direction of arrow F1 and which is not itself illustrated.

According to FIG. 3, the edge region 6 has been completely inserted in the groove 5. The bulge 8 thus bears against the associated wall of the groove 5. The bulge 8 forms the abutment and a sealing lip to prevent the penetration of water. The groove cavity 15 has dimensions such that when the edge region 6 is completely inserted, the camber 9 is deflected downwards by the wall of the groove, thus the wedge-shaped shoulder 11 is pressed firmly against the stop face 7 of the groove cavity 15. The lower projection 10 to a certain extent forms a stop to prevent the edge region 6 from being pushed too far into the groove 5. An equalization space 14 for equalizing tolerance variations is produced on the upper side of the completely inserted edge region 6. The position of the camber 9 and of the bulge 8 relative to the wedge-shaped shoulder 11 is characterised by the lever arms $h_1$ and $h_2$.

In conjunction with FIG. 3, it becomes clear that the secure retention of the edge region 6 inserted in the groove 5, achieved with the aforedescribed sectional strip, is brought about substantially by a controlled deformation of the edge region 6 inside the groove 5. As a result of the downwardly directed deflection of the outer end of the edge region 6, comprising the camber 9, (according to arrow F2), the lower shoulder 11 is braced against the stop face 7 of the groove wall. Thus, the entire cross-section of the edge region 6 including the shoulder 11 becomes active at the time of tensile stress, that is to say the tensile load may be correspondingly great.

FIG. 4 shows diagrammatically an assembly tool 16 with flaps 17 which fold out at the lower end. If the assembly tool is raised in the directon of arrow F3, then the ends of the flaps 17 underpin the bulges 8 directed inwards in the illustrated position of the sectional strip, so that the sectional strip is raised as a whole. The hollow fillets 12 on the underside of the edge region 6 bear against the lower sides of the respective edge profile 3,4 and in this way bring about a deflection of the ends of each edge region in the direction of arrow F4 into the inside of the grooves 5. After completed deflection into the horizontal position of the edge regions 6, the latter are likewise inserted completely into the grooves 5 with a tool, by further pressing on the bulges 8 in the direction of arrow F1 (FIG. 2).

I claim:

1. An elastomeric sectional strip for sealing an expansion joint on a building, each edge of which is thickened for engagement in one of a pair of grooves bordering the joint, characterized in that seen in cross-section, in the installed position, each thickened edge region is supported at three points with respect to walls of the groove, said three-point support being defined by:

(a) a bulge on an upper side of said edge region, said bulge being located inside said groove adjacent its opening;

(b) a shoulder projecting in the form of a wedge into said groove in the opposite direction to the insertion direction on the underside of said edge region, said shoulder being supported against a corresponding stop face of said groove; and (c) a camber on said upper side of said edge region on or close to its outer end, each of said grooves having a hollow cross-section complementary to the cross-sectional shape of said thickened edge region, excepting for the upper camber of the sectional strip, the height of each groove in the inlet region being less than the thickness of said section, measured through the lower shoulder.

2. A strip as set forth in claim 1, wherein on the underside of the sectional strip opposite said camber, said edge region comprises a hollow fillet.

3. A strip as set forth in claim 1 wherein on the underside of said sectional strip, said edge region comprises a projection, which bears from outside against the corresponding edge of the groove.

4. A strip as set forth in claim 1 wherein, measured at right angles to the direction of the sectional strip, said lower shoulder is located between said upper camber and said upper bulge.

* * * * *